United States Patent [19]

Isaksson

[11] Patent Number: 4,533,899

[45] Date of Patent: Aug. 6, 1985

[54] JOYSTICK CONTROLLER WITH IMPROVED MOTION CONTROL WITH PLATE HAVING BEVELLED FLAT EDGES THAT CORRESPOND TO PLANES OF MANEUVERABILITY

[75] Inventor: Karl Isaksson, Eslöv, Sweden

[73] Assignee: Akermans Verkstad AB, Eslov, Sweden

[21] Appl. No.: 561,914

[22] Filed: Dec. 15, 1983

[30] Foreign Application Priority Data

Dec. 23, 1982 [SE] Sweden ..... 8207373

[51] Int. Cl.[3] ..... H01C 10/16; G05G 9/10

[52] U.S. Cl. ..... 338/128; 200/6 A; 74/471 XY

[58] Field of Search ..... 338/128; 200/6 A; 74/471 XY; 273/148 B, DIG. 28

[56] References Cited

U.S. PATENT DOCUMENTS

| | | | |
|---|---|---|---|
| 3,360,620 | 12/1967 | Ward | 200/6 A |
| 3,401,574 | 9/1968 | Doolittle | 74/471 XY |
| 3,550,466 | 12/1970 | Ham | 338/128 X |
| 4,306,208 | 12/1981 | Coors | 338/128 X |
| 4,375,631 | 3/1983 | Goldberg | 338/128 |
| 4,415,782 | 11/1983 | Elmberg | 200/6 A |
| 4,492,128 | 1/1985 | Heideberger et al. | 338/128 X |

OTHER PUBLICATIONS

Uston, *Electronic Fun With Computers and Games,* vol. 2, #1, Nov. 1983, pp. 28—31.

*Primary Examiner*—Roy N. Envall, Jr.
*Assistant Examiner*—C. N. Sears
*Attorney, Agent, or Firm*—Pearne, Gordon, Sessions, McCoy, Granger & Tilberry

[57] ABSTRACT

A control lever is distinctly movable in different planes for actuation of different control means. The control lever has, adjacent a control lever housing, a plate provided with a number of bevelled flat edges corresponding to the number of planes in which the control lever is movable. The plate is tiltable on its flat edges by means of movement of the lever on which is axially movable. A spring is provided between the plate and a fixed abutment on the lever for holding said lever in engagement with a seat and for urging said plate against a planar portion of the housing. When the lever is moved in a given direction, the plate is tilted or rocked about an edge against the action of the spring, with any risk of the lever moving in another undersired plane being effectively eliminated.

10 Claims, 4 Drawing Figures

JOYSTICK CONTROLLER WITH IMPROVED MOTION CONTROL WITH PLATE HAVING BEVELLED FLAT EDGES THAT CORRESPOND TO PLANES OF MANEUVERABILITY

The present invention relates to a control lever arrangement comprising a housing and a lever non-rotatably mounted in and protruding from said housing. The lever is manually movable in all directions from its initial position to actuate control means provided in said housing, but is especially and distinctly movable in at least two planes forming an angle with one another and representing the operation of a specific function for which interference from adjacent functions is undesirable.

In control levers of this type, one strives to hold the lever in the desired plane by means of springs, which may cause difficulties, since the control means (i.e. potentiometers) to be actuated, are highly sensitive. A deviation of but a few degrees from the plane intended may result in the actuation of not only the control means intended, but also of an adjacent one. If the control lever is mounted in an excavator, this may result in an undesired actuation of an excavator function.

It is the object of this invention to provide a control lever arrangement by which an undesired actuation of control means is positively avoided, without jeopardising for that reason the overall maneuverability of the machine.

To acheive this object, a plate is non-rotatably but displaceably mounted on the lever and adapted to rest against a planar portion of the housing around the fulcrum of the lever therein and to be held in engagement therewith by means of a compression spring provided between the plate and a fixed abutment on the lever, said plate having at least two flat edges forming with one another the same angle as the said distinct lever planes and extending perpendicular each to one of these planes, and said plate being tiltable against the action of the spring when the lever is moved to actuate the desired control means.

The invention will be described in greater detail below, reference being made to accompanying drawings showing embodiments of the invention. In the drawings FIG. 1 is a substantially vertical section of a control lever arrangement according to the invention;

Figure 2:
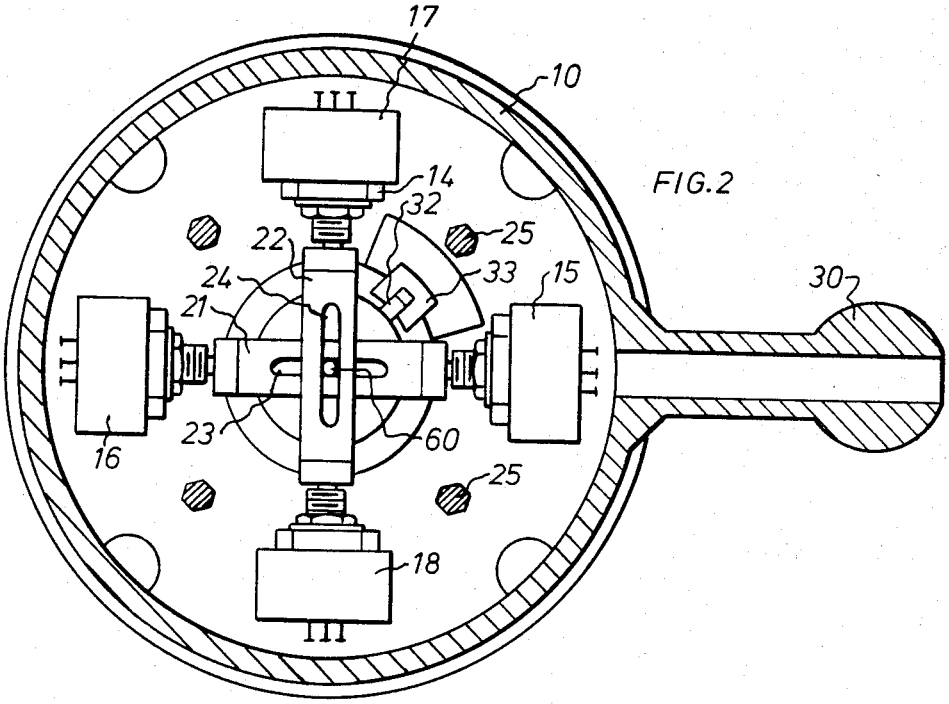
FIG. 2 is a section along line II—II in FIG. 1.

The control lever arrangement according to the invention has a housing 10 with a cover 11 and a protruding attachment member 30. A block 12 is secured by means of four screws in a central opening in the cover 11. A control lever 13 is movably mounted within the block 12, as will be described in greater detail below. Four flanges 14 project from the inside of the cover 11 into the housing, and on each of these flanges a potentiometer 15–18 is mounted in conventional manner by means of nuts 19. The rotable journals 20 of the potentiometers 15–18 are directed inwardly towards the center of the housing. The journals 20 of the potentiometers 15, 16 which are mounted opposite one another, are connected each to one end of a semicircular yoke 21, while the rotatable journals 20 of the potentiometers 17, 18 located opposite one another are similarly connected each to the end of a semicircular yoke 22 having a radius slightly greater than that of the yoke 21. The yoke 21 has an elongated central slit 23, and the yoke 22 has a similar slit 24. In one initial position, the yokes 21 and 22 intersect one another, and so do the slits 23 and 24, as will be clearly apparent from FIG. 2. Four screws 25 are screwed into the inner side of the cover 11 and carry a circuit card 26 adjacent the housing side parallel to the cover 11.

The block 12 which is mounted in the center of the cover 11, has a central recess 27 in the form of a truncated cone or pyramid or a tapered body having a base surface of different shape, the tapered downwardly facing part of which merges in a part-spherical recess 28 on the underside of the block 12. The lever 13 is provided at its lower end with a ball 29 having the same radius as the recess 28, and it appears from FIG. 1 that the lever 13 is so fulcrumed by means of said ball 29 and said part-spherical recess 28 that it extends centrally upwards through the recess 27. The ball 29 is held in engagement with the part-spherical recess 28 by spring force, as will be explained below. By being fulcrumed in this manner, the lever 13 is movable in different directions, and the angle through which it is moved is defined by the inclined sides of the recess 27, as will be clearly apparent from FIG. 1. The lever 13 is in the form of a tube, and extending through the ball 29 are radial, interconnected passages 31 for running wires from the interior of the housing up to through the lever to operating buttons, as will be described in greater detail below. The ball 29 also has a radially extending pin 32 (FIG. 2) adapted to engage with grooves provided in a holder 33 fixedly connected with the housing and adapted to prevent rotation of the lever 13.

For convenient movement of the lever 13 in the desired direction, the lever is disposed within a handle 34, more particularly in a sleeve 35 which is provided in a longitudinal recess issuing from the lower end of the lever, and is retained therein by means of a screw 36. On its side facing the housing, the handle 34 carries a plate 37 with an annular flange 38 which is secured in the sleeve 35 by means of a screw 39. The flange 38 surrounds an opening in the plate 37, and extending through the plate 37 and the flange 38 is a bushing 40 having a through opening so that the lever 13 can extend therethrough. At the end of the lever 13 facing away from the housing, an abutment 41 is secured by means of a scew 42, and extending through a threaded bore in the abutment 41 is a screw 43. On the inner side of the abutment 41 a cylindrical actuator 44 is displaceably mounted on the lever 13. Between the actuator 44 and the bush 40 extending through the plate 37 and the annular flange 38 thereof, a compression spring 46 is mounted whose tension can be set by screwing the screw 43 toward and away from the actuator 44. The screw 43 is accessible from the outer side of the handle 34 via a bore 45. A pin 47 is mounted in the wall of the sleeve 35 and projects into an axial groove in the actuator 44 in order to counteract, like the pin 32 previously mentioned, rotation of the lever 13 and the handle 34, respectively, about the longitudinal axis of said lever and said handle. The elements 40 and 44 being movable on the lever 13, whereas the abutment 41 is fixedly connected therewith, the spring 46 will urge the underside of the plate 37 against the upper side of the block 12 and the upper peripheral portion of the ball 29 against the area of contact of said partspherical recess 28, as will appear from FIG. 1. In this manner, the lever 13 and the handle 34 are safely held in position on the housing 10. As will appear, the handle 34 is provided at its upper end with operating buttons 48, 49, and the wires to these buttons extend through the interior of the lever 13 and the previously mentioned passges 31 within the ball 29.

Figure 1:
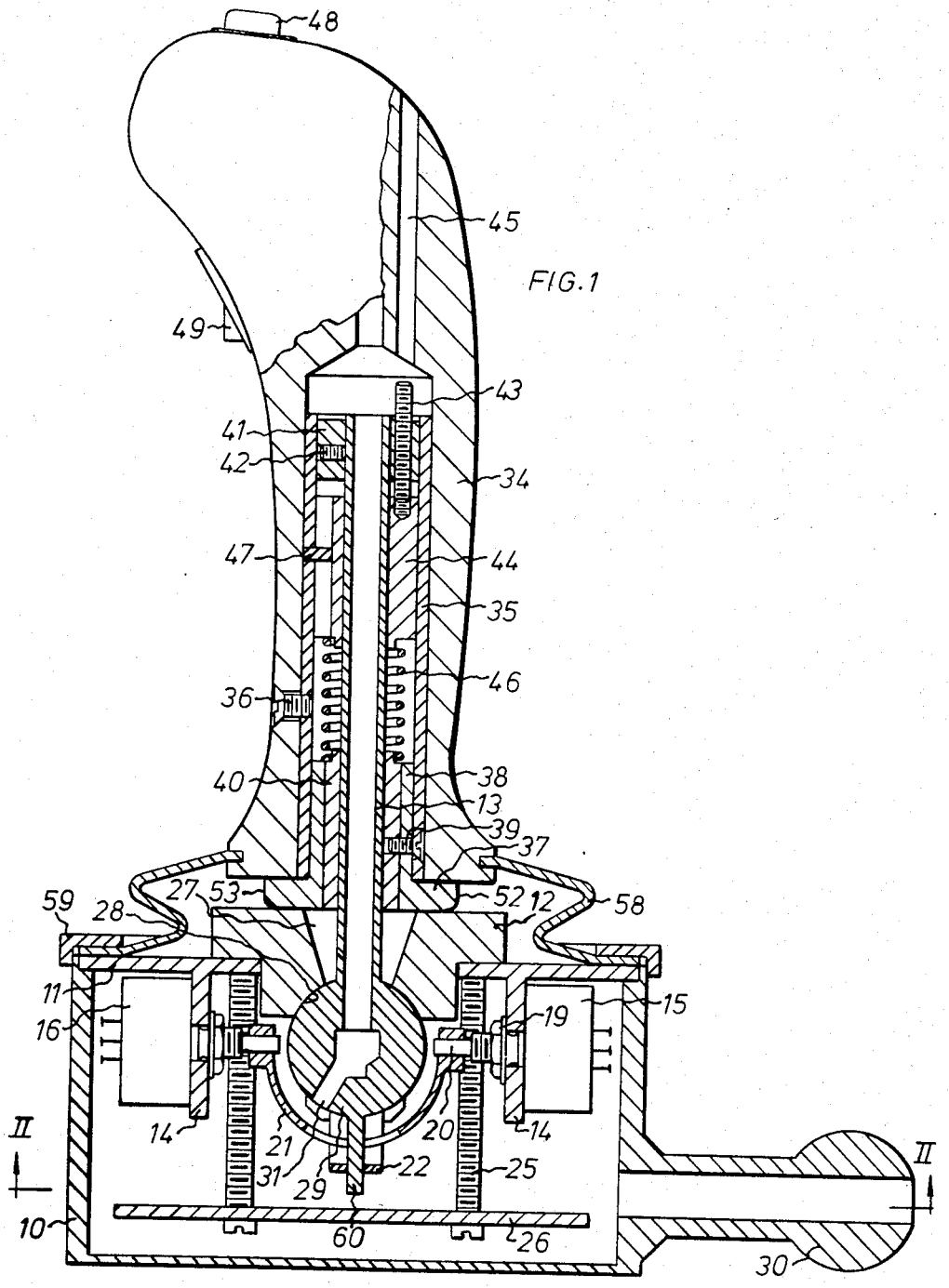
Figure 3:
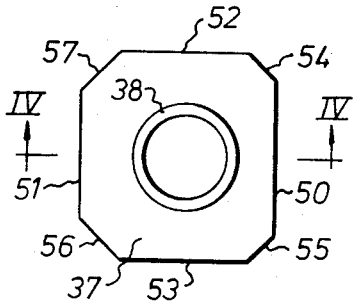
FIG. 3 illustrates a plate comprised by the arrangement shown in FIG. 1.
Figure 4:
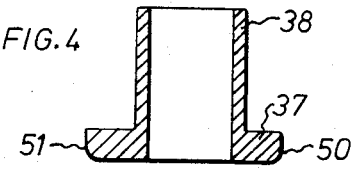
FIG. 4 is a sectional view of said plate, taken along line IV—IV in FIG. 3.

The plate 37 on the underside of the handle 34 plays a significant part because it carries out the desired distinct movement of the lever and the handle 34, respectively, in the desired planes. In the embodiment illustrated, which comprises four potentiometers 15–18, the lever 13 and the handle 14 should be movable forwards and backwards, respectively, and also in the tow lateral directions from a central initial position, i.e. in two planes intersecting one another at right angles, without risk that the lever will be moved out of the selected plane. For this reason, the plate 37 is rectangular with flat side edges 50, 51, 52 and 53 which, as will appear from FIG. 4, are bevelled or rounded. It will be appreciated that, if the lever in FIG. 1 is moved outwards to the right, the plate 37 will be tilted about the flat edge 50, simultaneously as the flat edge 51 is slightly raised from the upper side of the block 12, the spring 46 being tensioned at the same time. If the lever is moved to the left, tilting occurs about the edge 51, while the plate 37 is tilted about the edges 52 and 53, respectively, when the lever is moved forwards and backwards. Occasionally, it may be desirable to actuate more than one potentiometer 15–18 at the same time. For this reason, the edges of the plate 37 are bevelled so that further edges 54–57 are formed. Thus, if it is desired to actuate the potentiometers 15 and 18 (FIG. 2) to the same degree at the same time, the lever 13 and the handle 34, respectively, are moved in a plane forming an angle of 45° with the plane in which the lever is moved to the right, the plate 37 being tilted about the edge 54. If, however, it is desired to move the lever 13 and the handle 34, respectively, into other positions than those described above, i.e. if it is desired to actuate the potentiometers 15 and 18 in different degrees, greater lever forces are obtained, and this means that information about the angle in which the lever is moved is constantly available. It appears from FIG. 3 that the distance between the center of the plate 37 and the edge 50 is less than the corresponding distance between the center and the edges 51, 52 and 53. This means that it is easier to move the lever outwardly to the right than inwardly, rearwardly and forwardly, and this in turn is due to the fact that the lever movement then is felt to be heaviest in the outward direction towards the right. This applies to a right-hand lever. The left-hand lever has the edge corresponding to the edge 50 to the left.

As will appear from FIG. 1, the junction between the lever 13 and the housing 10 is protected in conventional manner by a rubber bellows 58 which is let into a peripheral groove in the handle 34 and is held to the housing 10 by means of a ring 59.

Although the lever according to the invention, as will appear from the drawings, can be moved in every direction from a central position, it has eight more frequently used directions in four planes intersecting one another along the center line of the control lever arrangement and disposed at an angle of 45° to one another, the distinct positions of said planes being readily perceptible upon operation. To make the lever movement as smooth as possible, the block 12 preferably is made of a material having a low coefficient of friction, such as Teflon, (a registered trademark of Dupont de Nemours, Inc. for polytetrafluoroethylene) while the plate 37 is made of steel. The potentiometers 15–18 are actuated by means of a control pin 60 extending downwardly from the ball 29 and through the slits 23 and 24 in the superimposed yokes 21 and 22 which extend approximately around half the periphery of the ball, as will be seen from FIG. 1. It appears that, if the control lever is moved forwards or to the right with respect to FIG. 1, the axes of the potentiometers 17, 18 will be rotated in clockwise direction, while the potentiometers 15 and 16 are not actuated at all because the control pin 16 is moving longitudinally of the slit 23. When the lever is moved in the plane forming an angle of 45° with respect to the forwardly directed plane, i.e. when the plate 37 is tilted about the edge 54, all of the potentiometers will of course be actuated. The arrangement illustrated makes it possible to obtain control curves of a uniformity which has hitherto been unattainable, and this means that the machine can be controlled without the stepwise or abrupt changes of movement which so far has been unavoidable.

The drawings illustrate four potentiometers disposed symmetrically about the center line, but it will be appreciated that the number of control means can be both increased and reduced.

What I claim and desire to secure by Letters Patent is:

1. A control lever arrangement comprising in combination a housing, control means within said housing, a lever non-rotatably mounted in said housing and projecting therefrom, said lever being manually movable in every direction from its initial position for actuating the control means within said housing, but being especially and distinctly movable in at least two planes forming an angle to one another and representing the operation of a specific function for which interference from adjacent functions is undesirable, a plate non-rotatably but displaceably mounted on said lever, means forming a planar portion on said housing about the lever fulcrum therein, a spring provided between said plate and a fixed abutment on said lever for holding said plate in planar engagement with said planar portion, said plate having at least two flat edges forming the same angle with one another as the said distinct plane of lever movement and extending at right angles each to one of said planes, said plate being tiltable about said flat edges and substantially non-slidable along said planar portion against the action of said spring when said lever is moved for actuation of a desired control means.

2. A control lever arrangement as claimed in claim 1, in which said lever is distinctly movable, from a vertical initial position, in opposite directions in at least two planes forming an angle with one another, to actuate control means disposed about the line along which said planes intersect one another, wherein said lever plate has parallel flat edges on either side of said line.

3. A control lever arrangement as claimed in claim 1, in which said flat edges about which said plate is tiltable, are bevelled or rounded to facilitate tilting.

4. A control lever arrangement as claimed in claim 1, in which said lever plate has a flat edge between at least a pair of adjacent flat edges corresponding each to one lever movement plane, said first-mentioned flat edge forming the same angle with each of said adjacent flat edges to facilitate movement of said lever in an intermediate plane for simultaneous actuation of two control means.

5. A control lever arrangement as claimed in claim 1, wherein the distance between the point where said lever is connected to said plate and one of said flat edges is less than the distance between said point and the remaining flat edges to facilitate tilting about said edge.

6. A control lever arrangement as claimed in claim 1, wherein the planar portion of said housing is formed by the upwardly facing said of the block centrally mounted on said housing and having a central recess issuing from said side and tapering towards the interior of said housing, the narrower part of said recess on the block side facing the interior of said housing being widened to form a part-spherical portion in which a ball fixed to said lever is mounted, such that said lever extends outwardly through said tapered recess, the circumferential surface of which thus defines the angle of lever movement.

7. A control lever arrangement as claimed in claim 1, wherein the lever end facing away from said housing is provided in a sleeve within a handle fixedly secured, on its side facing said housing, to said lever plate, and wherein said lever at its end facing away from said housing is provided with said fixed abutment against which the spring on said lever engages via a member provided on said lever and movable, for control of said spring tension, towards and away from said spring by means of a screw provided in a threaded bore within said fixed abutment and actuatable from the outside of said handle.

8. A control lever arrangement as claimed in claim 1, wherein said control means are in the form of rotary potentiometers, the rotor shaft of each potentiometer being connected to the end of an arcuate yoke having a slit in which the lever end formed with a pin and located within said housing, is longitudinally movable so that, when said lever is moved, the shaft of a control means connected to the end of said yoke is rotatable by transverse movement of said yoke, an adjacent yoke of identical design and perpendicular thereto remaining unactuated through longitudinal movement of said pin with said slit.

9. A control lever arrangement comprising in combination a housing, control means within said housing, a lever non-rotatably mounted in said housing and projecting therefrom, said lever being manually movable in every direction from its initial position for actuating the control means within said housing, but being especially and distinctly movable in at least two planes forming an angle to one another and representing the operation of a specific function for which interference from adjacent functions is undesirable, a plate non-rotatably but displaceably mounted on said lever, means forming a planar portion on said housing about the lever fulcrum therein, a spring provided between said plate and a fixed abutment on said lever for holding said plate in planar engagement with said planar portion, said plate having at least two flat edges forming the same angle with one another as the said distinct plane of lever movement and extending at right angles each to one of said planes, said plate being tiltable from said planar engagement about said flat edges to establish a line of contact between said plate and said planar portion, the distance between said line of contact and the longintudinal axis of said lever being substantially constant during movement of said lever against the action of said spring to substantially eliminate sliding contact between said plate and said planar portion.

10. A control lever arrangement comprising in combination a housing, control means within said housing, a lever non-rotatably mounted in said housing and projecting therefrom, said lever being manually movable in every direction from its initial position for actuating the control means within said housing, but being especially and distinctly movable in at least two planes forming an angle to one another and representing the operation of a specific function for which interference from adjacent functions is undesirable, a plate non-rotatably but displaceably mounted on said lever, means forming a planar portion on said housing about the lever fulcrum therein, a spring provided between said plate and a fixed abutment on said lever for holding said plate in planar engagement with said planar portion, said plate having at least two flat edges forming the same angle with one another as the said distinct plane of lever movement and extending at right angles each to one of said planes, said plate being tiltable about said flat edges and substantially non-slidable along said planar portion against the action of said spring when said lever is moved for actuation of a desired control means, an end of said lever facing away from said housing being provided in a sleeve within a handle fixedly secured, on its side facing said housing, to said lever plate, said lever at its end facing away from said housing being provided with said fixed abutment against which the spring on said lever engages via a member provided on said lever and movable, for control of said spring tension towards and away from said spring by means of a screw provided in a threaded bore within said fixed abutment and actustable from the outside of said handle.

* * * * *